US005829687A

United States Patent [19]

Byles

[11] Patent Number: 5,829,687

[45] Date of Patent: Nov. 3, 1998

[54] INDEPENDENTLY VARIABLE ARC LOW-FLOW SPRAY HEAD APPARATUS AND METHOD

[75] Inventor: Joe D. Byles, Fresno, Calif.

[73] Assignee: Nibco, Inc., Elkhart, Ind.

[21] Appl. No.: 705,812

[22] Filed: Aug. 30, 1996

Related U.S. Application Data

[60] Provisional application No. 60/003,050 Aug. 31, 1995.

[51] Int. Cl.[6] ..... B05B 1/14

[52] U.S. Cl. ..... 239/551; 231/555; 231/562

[58] Field of Search ..... 239/550, 551, 239/554, 555, 562

[56] References Cited

U.S. PATENT DOCUMENTS

| | | | |
|---|---|---|---|
| 1,189,593 | 7/1916 | Lynn | 239/554 |
| 1,383,404 | 7/1921 | Kirgan | 239/554 |
| 1,885,219 | 11/1932 | Bills et al. | 239/554 |
| 5,071,072 | 12/1991 | Baun | 239/551 |
| 5,083,709 | 1/1992 | Iwanowski | 239/551 |
| 5,490,778 | 2/1996 | Meijer | 239/554 |
| 5,630,549 | 5/1997 | Le | 239/451 |

*Primary Examiner*—Andres Kashnikow
*Assistant Examiner*—Lisa Ann Douglas
*Attorney, Agent, or Firm*—Shaffer & Culbertson; Russell D. Culbertson

[57] ABSTRACT

An irrigation spray head includes a plurality of orifices each for directing irrigation water in a substantially continuous stream to an impact location within an area around the spray head to be irrigated. Each orifice has associated with it a mechanism for adjusting the flow area and thereby adjusting the flow rate through the orifice and the distance between the spray head and the impact location associated with the respective orifice. Each substantially continuous discrete stream emitted through one of the orifices is at a flow rate higher than the local hydraulic loading rate associated with the soil in the respective impact location. Thus, each stream of water from the spray head produces localized runoff and a wide wetting pattern around each impact location. The flow rate for each stream is chosen so that the wetting pattern associated with each impact location combines with the other wetting patterns to substantially cover the entire area to be irrigated.

10 Claims, 3 Drawing Sheets

INDEPENDENTLY VARIABLE ARC LOW-FLOW SPRAY HEAD APPARATUS AND METHOD

BACKGROUND OF THE INVENTION

This application claims the benefit of the United States provisional patent application Ser. No. 60/003,050 filed Aug. 31, 1995, which is incorporated herein by reference.

The purpose of this invention is to provide a replacement nozzle for commonly used pop-up spray head bodies which allows for variation in both wetted arc and diameter and which can be configured in the field to provide a multitude of various configurations. The nozzle allows for a segment of the pattern to have a smaller radius independent of other arc segments. The nozzle also provides very efficient use of water since the main source of distribution within the soil is based upon delivering the water via a discrete jet to a point in the soil and allowing capillary action to further distribute the water to the root zone. The following describes some common problems of conventional spray irrigation systems and nozzles which this new and useful invention overcomes.

State of the art spray irrigation systems use various types of nozzles to distribute water over a circular area. Nozzles currently are purchased in various predetermined configurations such as half circles, quarter circles, full circles, etc. This leads to a large number of components that irrigation installer must deal with. These nozzles have a threaded screw in the middle of the nozzle which breaks up the flow and allows for a minor adjustment to the wetted diameter of the circular pattern, but while the diameter can be slightly altered, it must be the same for the entire pattern (i.e. if the diameter is reduced from 15 ft. to 10 ft., it must be a complete 10 ft. diameter for the entire circle and cannot be a 15 ft. diameter for a certain arc and a 10 ft. diameter for another arc segment). Some current nozzles allow for a shield to be moved or other mechanisms which allow for arc adjustments on spray nozzle arcs, but these devices cannot independently vary the arc or have multiple arcs and multiple radiuses for various segments of the pattern. The problem that this leads to is that odd and arbitrary shapes of areas to be irrigated cannot be done efficiently. It is typical and accepted for an irrigator to use the closest configuration and accept "incidental" irrigation outside of borders. This "incidental" irrigation leads to waste of water and liability hazards as sidewalks and streets are irrigated.

Another problem with spray irrigation systems is that they attempt to distribute water uniformly through the air and atmosphere above the area irrigated. This means that if one monitored every square inch of area below the wetted diameter of a spray pattern, every square inch would receive water from above. This is accomplished by sheets of water, fans of water and streams of water which place water droplets along the entire radius of their throw, from the spray head body to the extent of the throw. The intent of nozzles is to break up the sheet, fan or stream so that the water does not land in one general area, but rather a range or area. The problem is that this break up of the stream or fan makes many droplets which are subject to pattern distortion because of wind and slope. Also, breaking up a stream or fan into many droplets greatly increases the surface area and chance for evaporation from the free droplet surfaces. This leads to inefficiency and also makes it difficult for a half circle or quarter circle pattern to maintain all water in the desired area, leading to waste.

These inefficiencies of watering have lead to the exploration of a technology known as subsurface drip and surface drip. They are based upon placing water at discrete points and allowing the capillarity of the soil to further distribute the water in between points. These systems overcome the over spray of water past boundaries and non-intended areas, but are found not to save water and have much more difficulty in installation and maintenance. These systems however, are faced with problems such as uneven water distribution when placed subsurface, the inability to use surface drip irrigation in traffic and turf areas, root intrusion into emitters, and relatively expensive installation costs.

All of these state of the art irrigation systems have limited efficiency and use and there has been no effective solution for an efficient irrigation system which can be easily used, installed and maintained.

SUMMARY OF THE INVENTION

It is therefore a general objective of the invention to overcome the above described problems and others associated with irrigation systems, particularly devices and methods for irrigating turf with overhead spray patterns.

In order to accomplish this objective, the apparatus according to the invention includes a nozzle system device built up of multiple rings which are keyed to stack one on top of the other in a particular pattern. Molded or machined into the top of a ring is a series of grooves which form the lower half of a orifice which pressurized water flows out of in a stream pattern. The bottom surface of the ring directly above has a matching series of grooves which forms the upper half of the orifices. A series of rings are stacked on top of each other to create a series of orifices radially placed around the circular nozzle (i.e. every 45 degrees for a total of eight orifices for every two stacked rings) at a given height and typically a total of 32 orifices for five rings (four different height locations). The stacked rings also define an exit angle of the orifice relative to an axis parallel to the central axis of the nozzle. This angle is defined by the angle of the top of the bottom ring and the bottom of the top ring.

In between each stacked ring towards the center is a ring composed of a material which is slightly more compressible than that of the outer rings which form the orifices. The ring material seats in an inset section of the rings, forming a water tight seal between the two stacked rings when put into compression. The inner compressible ring has openings which correspond to the orifices, allowing the pressurized water to flow from an internal cavity of the nozzle assembly through the orifice and out in a stream like fashion. Extending from the compressible ring are small diameter fingers, which extend outward for a length greater than that of the formed orifice channels. The fingers, formed of the same material as the compression ring, fit within the orifice in a manner so as to allow the flow from the orifice or to block the flow from the orifice. The exit opening of the orifice has configurations to hold the particular finger exiting from that orifice either in a non-blocking position, to allow full flow from the orifice, a partially blocking position, so as to slightly break up the flow from the orifice, and a totally blocking position to completely block the flow from the orifice. The fingers therefore allow from each orifice to be independently open, blocked or partially blocked. The rings are typically injection molded from a hard plastic such as ABS and the compression rings can be injection molded from a softer plastic such as delrin or a rubber composite material.

The rings and compression rings are stacked, they are keyed to fit only one way, and held in compression with a screw which is molded into the ring at the very top of the nozzle, which also forms a cap for the device, and which threads into a female thread held in the center of the very bottom ring. By tightening the upper ring with the screw into the female thread, all of the compression rings are compressed and the nozzle assembly with all orifices and fingers are held in place. The use of the screw together assembly allows for the nozzle assembly to be taken apart, cleaned, and reassembled in the field effectively.

In operation, the nozzle assembly, which has a threaded connection on the bottom ring to accommodate a stem from a convention spray head, is threaded on a convention spray head. Pressurized water travels through the stem and through an internal cylindrical communication channel formed within the nozzle assembly by the stacking of the rings and compression rings, and out the orifices formed by the grooves in the adjacent top and bottom rings. Water flows in a stream pattern out of the orifices in which the finger is in the unblocked position, it flows in a disturbed pattern out of the orifices with a partially blocked position with many droplets, and does not flow at all out the orifices with the finger in the completely blocked position.

The angle at which the stream exits the orifice, determined by the angle of the adjacent top and bottom rings of the assembly, locates the stream at a specific point away from the spray nozzle assembly. Also, the size of the orifice and the amount of energy dissipation provided by the orifice channel and the compression ring channel to allow the water into the channel formed by the adjacent top and bottom rings, determines the flow rate exiting that orifice. The compression ring can be provided with protrusions or turns in its opening to dissipate energy and create a lower flow rate stream as needed. The combination of varying the radial distance and flow rate allows discrete watering points to efficiently irrigate a continuous circular area around the nozzle assembly. At a radial distance further from the nozzle, more area needs to be covered so a higher flow rate for each stream is used, i.e. at a five foot radial distance from the nozzle an 8 gallon per hour stream is used with eight streams spaced around the nozzle every 45 degrees. As the flow rate of a discrete watering point increases, the wetting area in the soil increases and the depth of watering decreases. In other words, as the discrete point watering exceeds the local hydraulic loading rate of the soil, the moves across the upper layers of the soil and on the surface, allowing less deep percolation and spreading out in an approximate circular area. In this manner, the heavy, discrete jets water in a manner similar to surface drip irrigation where a discrete point in the soil is watered from above and the soil moves the water to directly adjacent areas by capillarity of the soil, controlled to depth as described by the hydraulic loading rate of the soil. This discrete point watering avoids losses associated with overspray, evaporation (the water is not broken into many tiny droplets for uniform coverage and distribution, rather discrete jets which are distributed through the soil), and further evaporation from being captured on the turf and landscape plantings leaves. In addition, the discrete jet is much less affected by wind compared to the droplets of conventional spray heads.

The user of the nozzle can selectively and independently turn each orifice jet on or off by moving the compression finger to the open or blocked position. If a nozzle is made up of five rings, with the rings forming eight streams around the circumference of the nozzle, a total of 32 jet streams will be distributed in a typically 15 foot diameter area centered around the nozzle. At each area, the radius and arc of the pattern can be completely independently varied, allowing for a complete tailoring of the wetting pattern in an irregular shape, saving overspray watering common to previous used nozzles. If, for example, the nozzle has 32 independently variable jet streams that can be turned on or off, statistics dictate that the total number of possible configurations of the nozzle are $32\times31\times30\times29\times\ldots\times1=2.6313084\times10^{35}$ configurations. This does not include the fact that there is a partially blocked position which breaks up the stream and allows for a gentle misting in the area intended for the discrete stream, preventing seed washout for newly seeded turf lawns.

The total flow volume of all of the jets of the nozzle should be a lesser percentage of the total flow volume of a comparable, standard full circle spray head. For example, a typical full circle spray head which requires 15 foot spacing flows at approximately 4 gallons per minute. A discrete jet nozzle with 32 jets will flow a percentage of that, typically 1.5 to 2 gallons per minute. The lesser flow rate for the discrete jet device is due to the drip type watering, where water is distributed through the soil. This discrete jet nozzle, however, can be modified to provide a 4 gallon per hour flow rate with the same number of jets. The wetting pattern would not be as deep and more of a surface wetting pattern would be accomplished in a shorter time. If a lower percentage flow rate is used for the nozzle, more spray heads can be used on a single zone decreasing the need for breaking the overall irrigation system into more zones and utilizing fewer solenoid control valves, electrical wiring, and a smaller, less expensive controller.

These and other objects, advantages and features of the invention will be apparent from the following description of the preferred embodiments, considered along with the accompanying drawings.

DESCRIPTION OF THE PREFERRED EMBODIMENT

Figure 1:
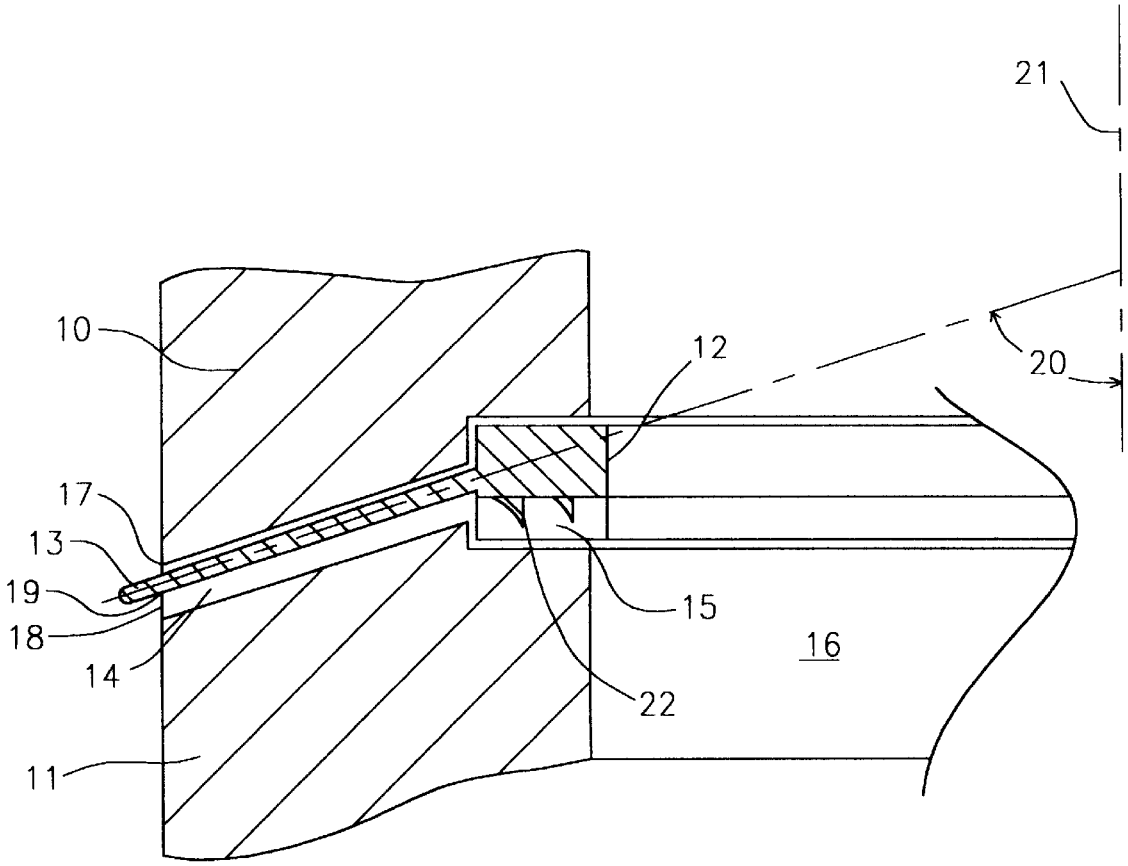
FIG. 1 is a cross sectional elevation showing a pair of rings and a compression ring forming an orifice channel. It also shows the finger for blocking the flow and allowing the flow to exit from the orifice.

FIG. 1 shows a partial cross section with an adjacent upper ring 10 and adjacent lower ring 11, the compression ring 12, the finger or sealing member 13 extending from the compression ring, the orifice channel 14 formed by the upper and lower ring, the compression ring opening 15 allowing water to flow from the internal conveyance channel 16 into the orifice channel 14, and the upper nonblocked position 17 of the finger 13 and the lower blocked position 18 of the finger 13. There is also a middle position 19 where the stream from the orifice 14 is partially blocked. The direction of the stream emitting from the orifice 14 is determined by the angle 20 formed by the upper and lower surface of the adjacent rings relative to the center axis 21 of the nozzle assembly. The flow rate of the orifice 14 is determined by the orifice 14 size and the amount of potential energy dissipation provided by flow disturbers 22 in the compression ring inlet area.

Figure 2:
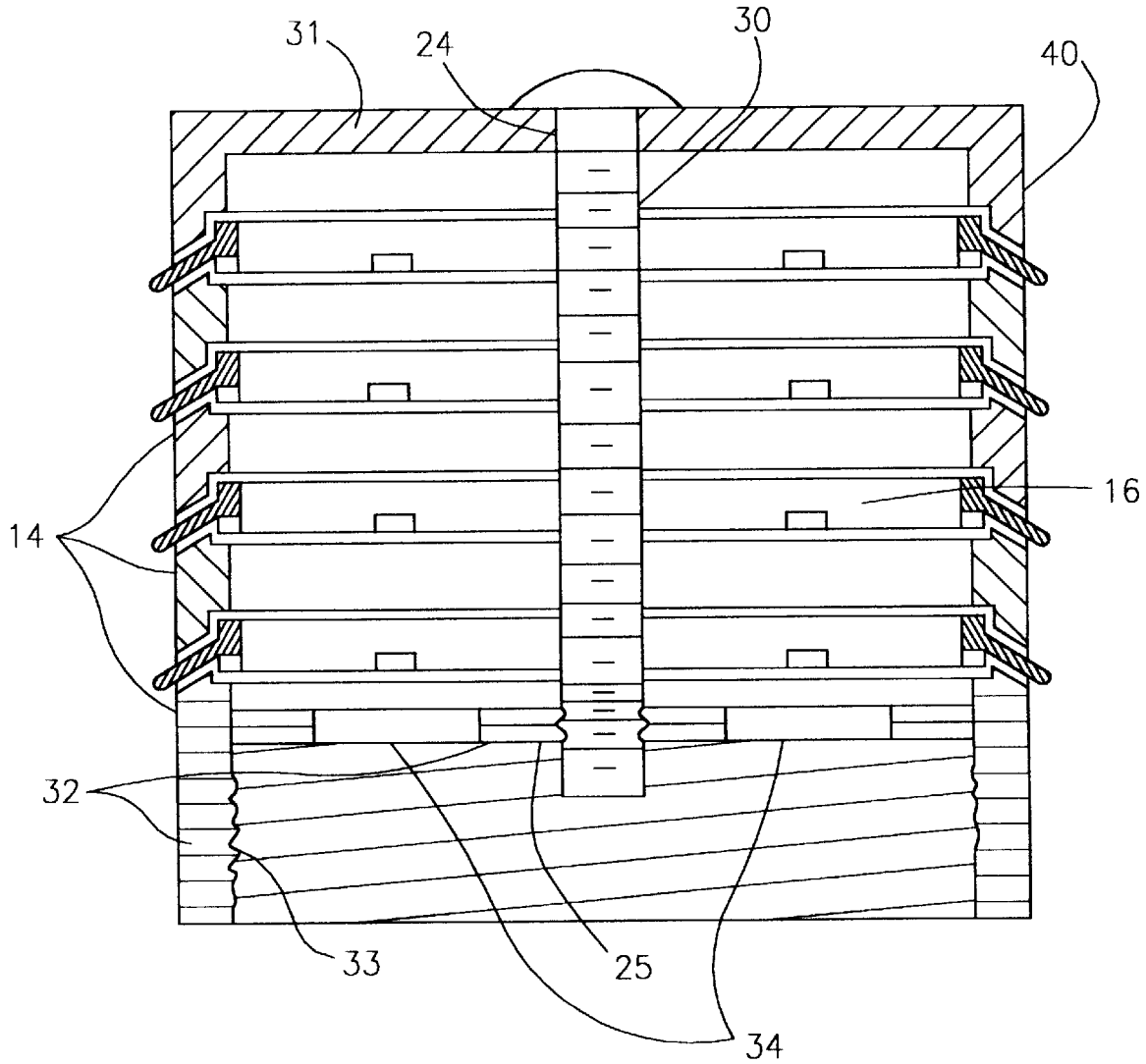
FIG. 2 is a cross sectional showing the complete nozzle built up of five rings, including the tightening screw and threaded fitting.

FIG. 2 shows an assembled nozzle or spray head body 40 built up of five ring assemblies and four compression rings. The cross section shows a central screw 30 which is attached to the upper most ring or top member 31 and threads into a lowermost ring assembly or bottom member 32. The central screw 30, the opening 24 in the upper-most ring 31, and the threads 25 in the lower-most ring 32 make up connecting means for connecting together the plurality of rings which make up the nozzle 40. The lowermost ring assembly 32 has a threaded fitting or water supply connector 33 to fit into a conventional spray head stem and openings 34 to allow pressurized water to flow from a spray head stem (not shown) into the conveyance channel 16 and out the orifices.

In operation, the nozzle assembly 40 is threaded on a convention spray head stem. Pressurized water moves through orifices 34 into the conveyance channel 16 and out of the individual orifices 14 at the preset angle 20 of each orifice 14. The stream emitting from each orifice is a discrete stream directed to a discrete area. By adjusting the individual fingers or flow adjusting means 13 for each orifice the flow can be full, completely blocked, or partially blocked.

Figure 3:
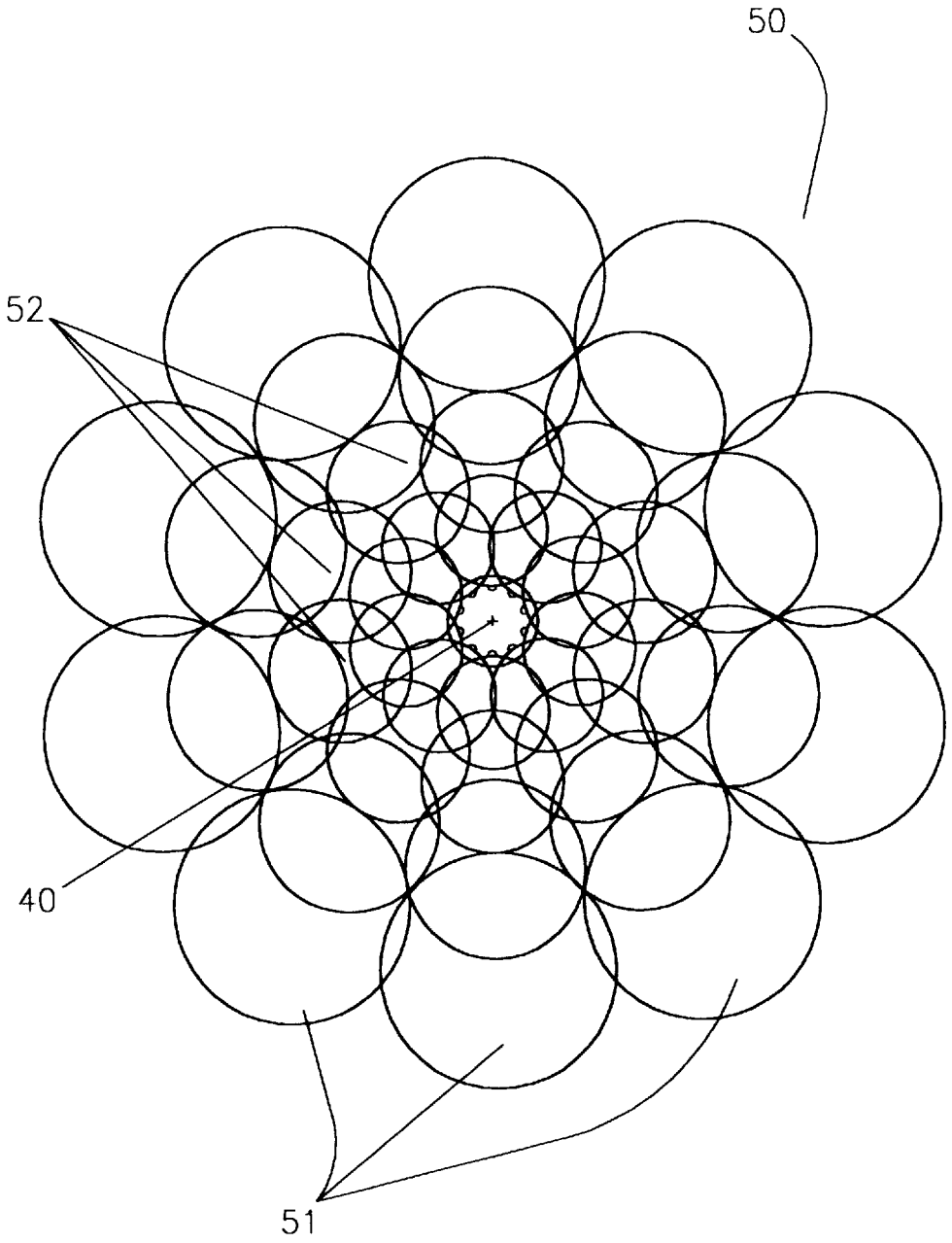
FIG. 3 shows the wetting pattern created around the nozzle with the nozzle at center.

FIG. 3 shows the resultant wetting pattern 50 of a full array of streams emitting from the nozzle 40. As the streams move to the outer areas of the radius, the wetting patterns 51 are larger because the flow rate from those orifices is larger. The larger wetting pattern also has a shallower wetting depth as the hydraulic loading rate is overcome. The inner wetting patterns 52 have smaller wetted areas proportionally deeper wetting depths due to the smaller flow rate. The overall resultant wetting pattern 50 is uniform coverage to uniform depth for a circular area.

The above described preferred embodiments are intended to illustrate the principles of the invention, but not to limit the scope of the invention. Various other embodiments and modifications to these preferred embodiments may be made by those skilled in the art without departing from the scope of the invention described.

I claim:

1. An irrigation spray head comprising:

(a) a spray head body;

(b) a water supply connector associated with the spray head body for connecting the spray head body to a spray head stem and enabling the spray head body to receive irrigation water from the stem;

(c) a plurality of orifices associated with the spray head body, each orifice for emitting water in a substantially continuous stream at a water distributing flow rate to a different impact location about the spray head body when irrigation water is applied to the spray head body through the water supply connector at a desired pressure and flow rate; and (d) flow adjusting means associated with each orifice for adjusting the flow area of each respective orifice independently of each other orifice such that the water distributing flow rate exceeds the local hydraulic loading rate at the respective impact location.

2. The apparatus of claim 1 wherein the spray head body comprises:

(a) a top member;

(b) a bottom member having the water supply connector formed therein;

(c) a plurality of rings stacked together between and aligned with the top member and bottom member; and (d) connecting means associated with the top member and bottom member for compressing the stacked and aligned top member, rings, and the bottom member together to produce a substantial seal between adjacent rings, between the top member and the uppermost ring, and between the bottom member and the lowermost ring.

3. The apparatus of claim 2 wherein the water supply connector comprises:

(a) a female threaded connector formed on the bottom member.

4. The apparatus of claim 2 wherein the orifices comprise radially extending grooves formed between adjacent rings, between the uppermost ring and the top member and between the lowermost ring and the bottom member.

5. The apparatus of claim 2 further comprising:

(a) a plurality of sealing members, including one of said sealing members positioned between adjacent rings, one of said sealing members positioned between the uppermost ring and top member and one of said sealing members positioned between the lowermost ring and bottom member.

6. The apparatus of claim 2 wherein the connecting means comprises:

(a) a connecting opening formed generally in the center of the top member;

(b) a female threaded connector opening formed generally in the center of the bottom member; and (c) a connecting screw extending through the top member connector opening and threaded into the connector opening of the bottom member.

7. The apparatus of claim 1 wherein the flow adjusting means associated with each orifice comprises:

(a) a flow adjusting member extending into the respective orifice; and (b) positioning means for holding the flow adjusting member in either a blocking position in which the flow adjusting member blocks the orifice, an open position in which the flow adjusting member leaves the orifice open to flow, and an intermediate position in which the flow adjusting member partially blocks flow through the orifice.

8. A method of irrigating an area through a spray head, the method comprising the steps of:

(a) supplying irrigation water at a desired pressure and flow rate to the spray head;

(b) directing water from the spray head in a plurality of substantially continuous streams, each stream at a water distributing flow rate, and each stream impacting a different impact location within the area to be irrigated;

(c) the water distributing flow rate being a rate higher than a local hydraulic loading rate at the respective impact location of the respective stream so that each stream produces an extended wetting pattern around the respective impact location; and (d) the impact locations associated with the plurality of streams being spaced apart so that the extended wetting patterns produced by the plurality of streams combine to cover substantially the entire area to be irrigated.

9. The method of claim 8 wherein the step of directing water from the spray head includes:

(a) directing a first plurality of continuous streams, each continuous stream at a different angular orientation about a spray head axis and having a first radial distance from the spray head to the respective impact locations;

(b) directing a second plurality of streams each at a different angular orientation about the spray head and having a second radial distance from the spray head to the respective impact locations; and (c) wherein the first radial distance is longer than the second radial distance and the flow rate of the second plurality of streams is lower than the flow rate of the first plurality of streams.

10. The method of claim 8 wherein the desired flow rate is in a range from 1.5 gallons per minute to 4 gallons per minute.

* * * * *